US010688552B2

(12) United States Patent
Liu et al.

(10) Patent No.: US 10,688,552 B2
(45) Date of Patent: Jun. 23, 2020

(54) METHOD OF HOT GAS FORMING AND HEAR TREATMENT FOR A $TI_2ALNB$-BASED ALLOY HOLLOW THIN-WALLED COMPONENT

(71) Applicant: HARBIN INSTITUTE OF TECHNOLOGY, Harbin (CN)

(72) Inventors: Gang Liu, Harbin (CN); Shijian Yuan, Harbin (CN); Dongjun Wang, Harbin (CN)

(73) Assignee: HARBIN INSTITUTE OF TECHNOLOGY, Harbin (CN)

( * ) Notice: Subject to any disclaimer, the term of this patent is extended or adjusted under 35 U.S.C. 154(b) by 50 days.

(21) Appl. No.: 16/095,938

(22) PCT Filed: May 8, 2018

(86) PCT No.: PCT/CN2018/085969
§ 371 (c)(1),
(2) Date: Oct. 23, 2018

(87) PCT Pub. No.: WO2019/119711
PCT Pub. Date: Jun. 27, 2019

(65) Prior Publication Data
US 2020/0078848 A1 Mar. 12, 2020

(30) Foreign Application Priority Data
Dec. 18, 2017 (CN) ..... 2017 1 1367576

(51) Int. Cl.
*B21D 26/041* (2011.01)
*B21K 21/04* (2006.01)
(Continued)

(52) U.S. Cl.
CPC ..... *B21D 26/041* (2013.01); *B21K 21/04* (2013.01); *C22F 1/02* (2013.01); *C22F 1/183* (2013.01)

(58) Field of Classification Search
CPC .. B21D 26/033; B21D 26/047; B21D 26/055; B21D 26/02; B21D 26/027; B21D 26/029; B21D 26/053; B21D 26/041; B21K 21/04
See application file for complete search history.

(56) References Cited

U.S. PATENT DOCUMENTS

2004/0040636 A1* 3/2004 Watanabe ..... B21D 26/041 148/570
2011/0023568 A1* 2/2011 Yamamoto ..... B21D 26/033 72/61

FOREIGN PATENT DOCUMENTS

CN 106180345 A 12/2016
CN 107052127 A 8/2017
(Continued)

OTHER PUBLICATIONS

DE-10162416-A1 EPO machine Translation (Year: 2020).*
(Continued)

*Primary Examiner* — Pradeep C Battula
(74) *Attorney, Agent, or Firm* — Scully, Scott, Murphy & Presser, P.C.

(57) ABSTRACT

Provided herein is a method of hot gas forming and heat treatment for a $Ti_2AlNb$-based alloy hollow thin-walled component, which pertains to the technical field of plastic forming manufacture of thin-walled components made from difficult-to-deformation materials, more particularly, a forming method of $Ti_2AlNb$-based alloy hollow thin-walled components is involved. The purpose of this invention is to solve the existing problems that $Ti_2AlNb$-based alloy hollow thin-walled components are difficult to form, process steps
(Continued)

are complex, and the shape and dimension precision is in contradiction with the control of the microstructure and properties. The method comprises the following steps: (1) hot gas forming to obtain hot gas formed tube components, and (2) controllable-cooling heat treatment to obtain $Ti_2AlNb$-based alloy hollow thin-walled components. The advantages of this invention are as following: improving production efficiency, high dimensional accuracy, reducing energy consumption, achieving the integration of shape and performance control, and excellent mechanical properties. The invention also relates to $Ti_2AlNb$-based alloy hollow thin-walled components manufactured by a hot gas forming and heat treatment method.

15 Claims, 5 Drawing Sheets

(51) Int. Cl.
*C22F 1/02* (2006.01)
*C22F 1/18* (2006.01)

(56) References Cited

FOREIGN PATENT DOCUMENTS

| | | | | | |
|---|---|---|---|---|---|
| CN | 107199270 | A | | 9/2017 | |
| CN | 107052123 | A | | 8/2018 | |
| DE | 19642824 | A1 | * | 4/1998 | ..... B21D 26/033 |
| DE | 19907018 | A1 | | 8/2000 | |
| DE | 10162416 | A1 | * | 7/2003 | ..... B21D 26/029 |
| DE | 10162437 | A1 | * | 7/2003 | ..... B21D 37/16 |
| DE | 102006035239 | B3 | * | 6/2007 | ..... B21D 26/041 |
| JP | 2009220141 | A | | 10/2009 | |
| WO | WO 2017186217 | A1 | | 11/2017 | |

OTHER PUBLICATIONS

DE-102006035239-B3 EPO machine Translation (Year: 2020).*
DE-19642824-A1 EPO machine Translation (Year: 2020).*
DE-10162437-A1 EPO machine Translation (Year: 2020).*
International Search Report for PCT/CN2018/085969 issued by the World Intellectual Property Organization (WIPO)(dated Sep. 21, 2018)(5 pages).

* cited by examiner

METHOD OF HOT GAS FORMING AND HEAR TREATMENT FOR A $TI_2ALNB$-BASED ALLOY HOLLOW THIN-WALLED COMPONENT

TECHNICAL FIELD

The present invention pertains to the technical field of plastic forming manufacture of thin-walled components made from difficult-to-deformation materials, more particularly, involves a forming method of a $Ti_2AlNb$-based alloy hollow thin-walled component.

BACKGROUND ART

With the rapid development of aerospace industry, it is urgent to improve the efficiency of power system and reduce the energy consumption. A hollow thin-walled component with variable cross-sections, e.g., air inlet and spray tube, is a typical representive component widely used in aerospace vehicles, which is demanding and difficult to be manufactured. $Ti_2AlNb$-based alloys have high room-temperature ductility and fracture toughness, excellent high temperature properties such as creep resistance, fatigue resistance and oxidation resistance, as well as the advantages such as low density, low coefficient of thermal expansion and non-magnetic properties. Therefore, it has become one of the most potential materials to replace the superalloy at the service temperature of 600-800° C., which is of great significance for further reducing the weight of aerospace vehicles and improving the payload and flight speed.

The key components (e.g., the air inlet and spray tube) in power system of air vehicles need to bear high speed and high pressure air scouring, and the service environment is very severe. The working temperature of the component body is up to 600-800° C. and the gas pressure endured by the component is usually several MPa (dozens of atmospheric pressure), with a maximum value of 20 MPa (two hundred atmospheres). Therefore, it is necessary for this kind of component to have excellent service performances at a high temperature, including high strength and certain fracture elongation. Meanwhile, in order to meet the requirement of aerodynamics, realize the control of inlet air flow field and avoid the risk of melt-through caused by the excessive aerodynamic heat at the stationary point, the requirement for the shape and dimension accuracies of components such as the air inlet and spray tube are very high, especially the requirement for the accuracy of the inner surface is harsh.

In the aspect of shape and dimension accuracy control, due to the combination manner in hybrid bonds of coexisted metal bond and covalent bond among $Ti_2AlNb$-based alloy atoms, it has intrinsic brittleness and can only be formed at a high temperature. At the same time, since the hollow thin-walled components cannot be machined after forming, especially the inner surface of the components can hardly be machined, a high-temperature forming method with high accuracy is needed, which can directly meet the requirements of dimensional accuracy for surface during the forming process.

In terms of controlling the component's service performance, a $Ti_2AlNb$-based alloy is composed of $\alpha_2$, $B_2$ and O phases, wherein the intrinsic plasticity of the O phase is better than that of $\alpha_2$ phase. However, under the service condition, the internal crack of the component is easily formed at the equiaxed O/O phase grain boundaries, resulting in the intergranular fracture. Therefore, the content and morphology of the O phase have a significant effect on the high temperature service performance of $Ti_2AlNb$-based alloy components. Accordingly, for achieving excellent usage performance, a heat treatment of $Ti_2AlNb$-based alloy components is needed to be carried out after forming to optimize the microstructure (such as the content, morphology and size of O phase etc.).

However, the contradiction between the service performance control and the control to the accuracy of shape and dimension of $Ti_2AlNb$-based alloy hollow thin-walled components is very prominent. It is found in the development process that, if the components are taken out of the die after hot forming and then heat treated, it will lead to serious shape distortion, the poor dimensional accuracy and the scrap product due to the evolution of the microstructure and the temperature variation during the heat treatment process. Therefore, it is urgent to develop a new technology for integrated forming and performance control of $Ti_2AlNb$-based alloy hollow thin-walled components, so as to meet the impending needs of the aerospace aircraft development for $Ti_2AlNb$-based alloy hollow thin-walled components with high performance and high accuracy.

SUMMARY OF THE INVENTION

The purpose of this invention is to solve the existing problems that $Ti_2AlNb$-based alloy hollow thin-walled components are difficult to form, process steps are complex, and the shape and dimension accuracy is in contradiction with the control of the microstructure and properties, and a method of hot gas forming and heat treatment for $Ti_2AlNb$-based alloy hollow thin-walled components is thereby provided.

In one aspect, this invention relates to a hot gas forming and heat treatment method for a $Ti_2AlNb$-based alloy hollow thin-walled component, wherein the method comprises the following steps:

(1) hot gas forming: after a mould being heated to a forming temperature of 970-990° C., placing a tube billet into the mould, wherein the mould is provided with a gas inlet and a gas outlet;

after the mould being assembled, sealing an inlet end and an outlet end of the tube billet with an inlet seal plug and an outlet seal plug, respectively, wherein said inlet seal plug is provided with a gas inlet channel for supplying gas to a pipeline of the tube billet and an inlet switch for opening or closing the gas inlet channel, and said outlet seal plug is provided with a gas outlet channel for exhausting gas from the pipeline of the tube billet and an outlet switch for opening or closing the gas outlet channel;

then, keeping the tube billet at a temperature of 970-990° C. for 5 min-30 min; keeping the outlet switch closed and turning on the inlet switch, allowing compressed gas I to enter the pipeline of the tube billet through said gas inlet channel; performing the hot gas forming at a temperature of 970-990° C. and an inflation pressure of 5-70 MPa until the tube billet is completely formed, thereby obtaining a hot gas formed tube component;

(2) controllable-cooling heat treatment: turning on the outlet switch, and then introducing compressed gas II from the gas inlet channel into a pipeline of the hot gas formed tube component; keeping a gas pressure in the pipeline of the hot gas formed tube component in a range of 1 MPa-20 MPa; and air cooling the hot gas formed tube component at a cooling rate of 0.3-3.5° C./s;

when a temperature of the hot gas formed lube component being reduced to 780-830° C., stopping inletting the gas and keeping it at a temperature of 780-830° C. for 30-60 min;

then, further introducing said compressed gas II, keeping a gas pressure in the pipeline of the hot gas formed tube component in a range of 1 MPa-20 MPa, and air cooling the hot gas formed rube component at a cooling rate of 0.3-3.5° C./s:

when a temperature of the hot gas formed tube component being reduced to 400-500° C., stopping inletting the gas; opening the mould after releasing pressure through the gas outlet channel, and thereby obtaining the $Ti_2AlNb$-based alloy hollow thin-walled component.

The technical principle and advantages of the technical solutions in this invention:

(i) Hot gas forming principle of this invention: a $Ti_2AlNb$-based alloy thin-walled tube billet is employed as the tube billet, and the final shape of a component is controlled by the mould design and optimization. The mould is provided with a gas inlet and a gas outlet (also named as "gas vent"). After the mould is heated to the forming temperature, the tube billet is placed in the mould. The gas outlet is closed during a bulging process, and the gas inlet is used to maintain the inflation pressure. Under an action of a high temperature, the strength of a $Ti_2AlNb$-based alloy thin-walled tube billet decreases and its plastic deformation ability is improved. When the applied gas pressure makes the $Ti_2AlNb$-based alloy tube billet reach the yield condition, the purpose of the tube billet being formed close to the inner wall of the mould can be achieved via a plastic deformation manner. After finishing the bulging, both the gas inlet and the gas outlet are opened. The gas inlet services for inletting gas and the gas outlet services for exhausting gas, and they are used to control the cooling rate of the formed thin-walled components by adjusting the cooling gas. During the cooling process, a certain gas pressure is still maintained to ensure the shape and dimension accuracy of the formed components.

(ii) Optimization principle of microstructure and properties for $Ti_2AlNb$-based alloys: by properly increasing the cooling rate of he high-temperature region after forming, the purpose of reducing the size of the precipitated O phase lamella can be achieved. By combining with the appropriate aging heat treatment parameters, the microstructures of a small amount of equiaxed $\alpha_2$ phase and a suitable amount of fine lamellar O phase uniformly distributing in the matrix of fine B2 phase can be finally attained, so as to obtain excellent comprehensive performance.

(iii) The invention completes aging heat treatment at the same time of hot gas forming, and no additional heat treatment process is required, and thus the production efficiency is improved.

(iv) High dimensional accuracy: the heat treatment to the components is completed in the mould with the support of the gas pressure, which avoids the shape distortion caused by the heat treatment and leads to high dimension accuracy.

(v) After forming, the aging heat treatment is completed by using residual heat, and the energy consumption is reduced without reheating after cooling.

(vi) The cooling rate of the formed hollow thin-walled components are controlled through high pressure gas circulation in the mould, which overcomes the problems in the prior art, such as low cooling rate and long cooling time, and the excessive content and coarse size of O phase. Therefore, the $Ti_2AlNb$-based alloy hollow thin-walled component obtained by this invention has good microstructure and properties, which realizes the integration of shape and performance control.

(vii) The microstructure of the $Ti_2AlNb$-based alloy hollow thin-walled component obtained by this invention is as follows: a small amount of fine equiaxed $\alpha_2$ phase and an appropriate amount of fine lamellar O phase are uniformly distributed in the B2 phase matrix, wherein the lamella size of lamellar O phase is 50-300 nm.

(viii) The mechanical properties of the $Ti_2AlNb$-based alloy hollow thin-walled components obtained by this invention are as follows: tensile yield strength at room temperature is ≥1200 MPa, and tensile fracture strength at room temperature is ≥1350 MPa; under the high temperature condition (750° C.), tensile yield strength is ≥680 MPa (according to 0.2% plastic strain), tensile fracture strength is ≥780 MPa, and fracture elongation is ≥15%.

(ix) The indexes for the shape and dimension accuracy of the $Ti_2AlNb$-based alloy hollow thin-walled components obtained by this invention are as follows: dimension deviation is ≤0.2 mm, and angular deviation is ≤0.25°.

This invention is mainly used to manufacture a $Ti_2AlNb$-based alloy hollow thin-walled component by employing hot gas forming and heat treatment.

In the other aspect, this invention relates to the $Ti_2AlNb$-based alloy hollow thin-walled components prepared by the above-mentioned hot gas forming and heat treatment method.

Figure 8:
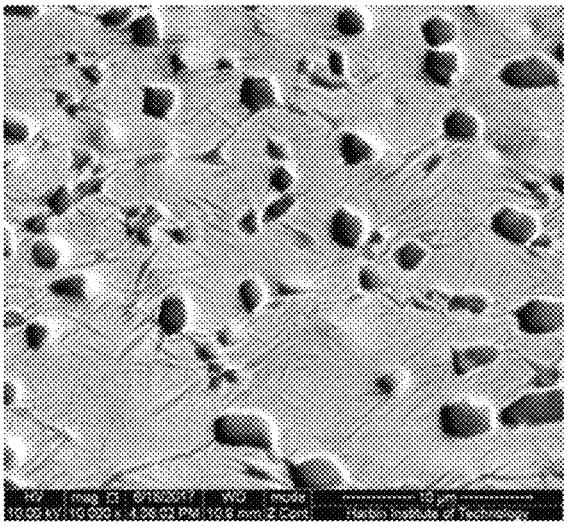

FIG. 8 is a microstructural image of an exemplary $Ti_2AlNb$-based alloy hollow thin-walled component obtained in Example 1.

Figure 9:
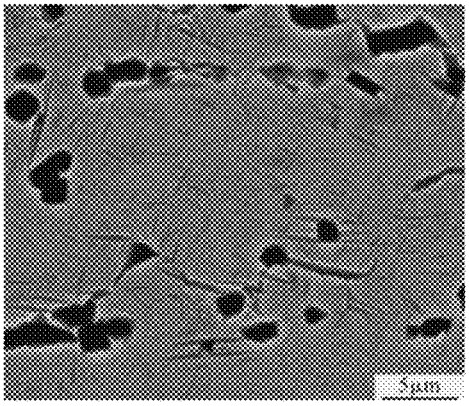

FIG. 9 is a microstructural image of an exemplary $Ti_2AlNb$-based alloy hollow thin-walled component obtained in Example 2.

Figure 10:
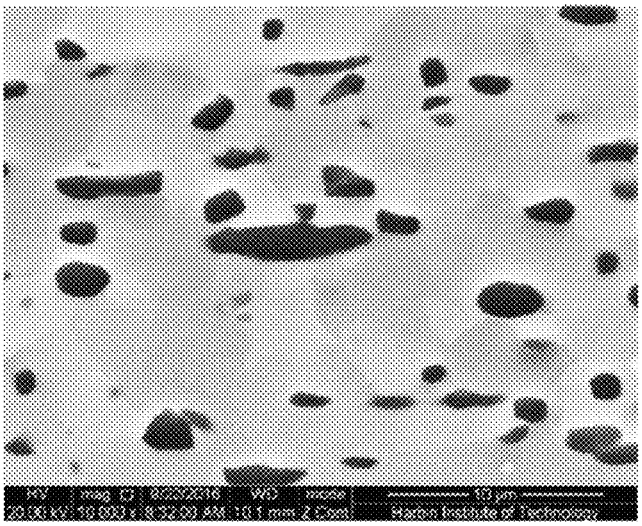

FIG. 10 is a microstructural image of a $Ti_2AlNb$-based alloy hollow thin-walled component obtained in Example 3.

Figure 11:
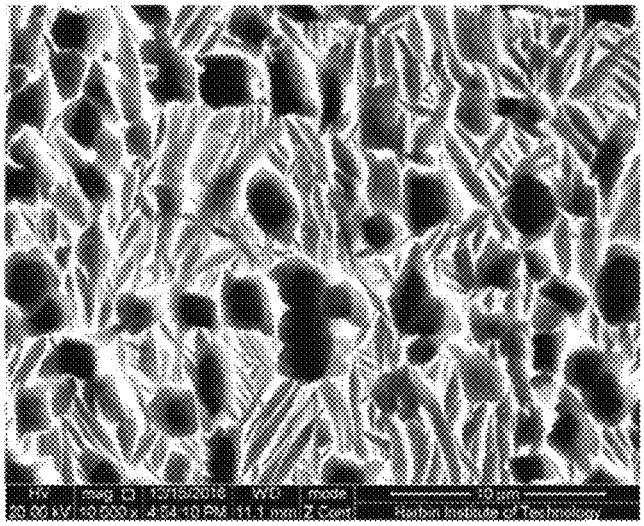

FIG. 11 is a microstructural image of a $Ti_2AlNb$-based alloy hollow thin-walled component obtained in Example 4.

Figure 12:
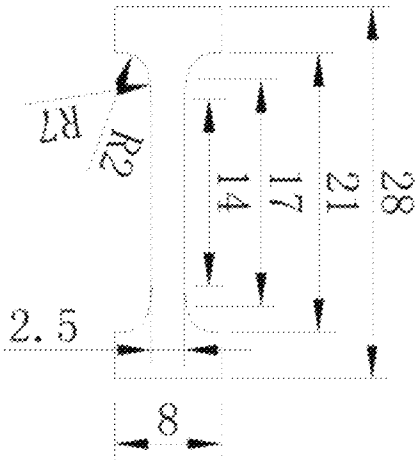

FIG. 12 is a diagram of test specimen for tensile performance of a $Ti_2AlNb$-based alloy hollow thin-walled component.

Figure 13:
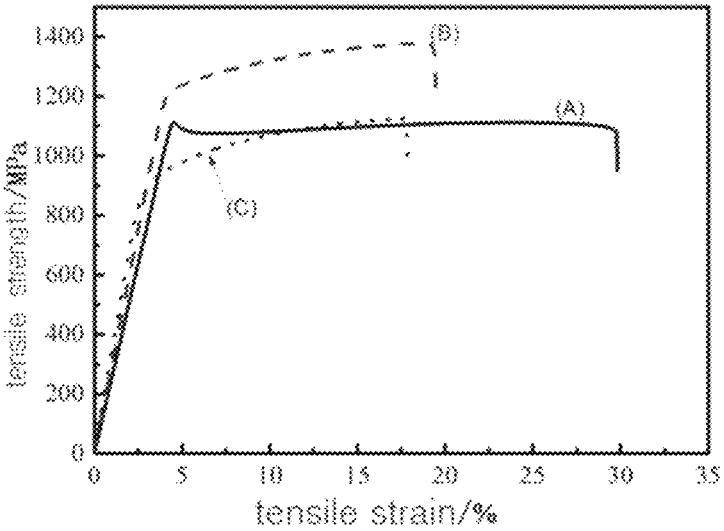

FIG. 13 is tensile performance curves at room temperature. In this Figure, A represents the tensile performance curve of the $Ti_2AlNb$-based alloy hollow thin-walled component obtained in Example 3 at room temperature, B represents the tensile performance curve of an exemplary $Ti_2AlNb$-based alloy hollow thin-walled component obtained in Example 1 at room temperature, and C represents the tensile performance curve of $Ti_2AlNb$-based alloy hollow thin-walled component obtained in Example 4 at room temperature.

Figure 14:
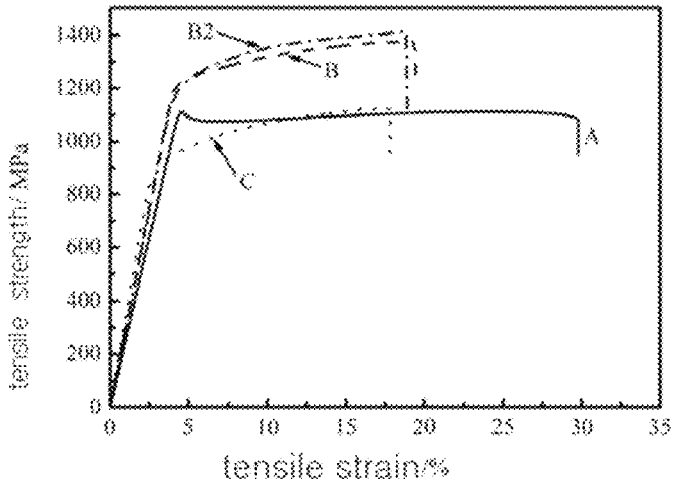

FIG. 14 is tensile performance curves at room temperature. In this Figure, A represents the tensile performance curve of the $Ti_2AlNb$-based alloy hollow thin-walled component obtained in Example 3 at room temperature, B represents the tensile performance curve of an exemplary $Ti_2AlNb$-based alloy hollow thin-walled component obtained in Example 1 at room temperature, B2 represents the tensile performance curve of an exemplary $Ti_2AlNb$-based alloy hollow thin-walled component obtained in Example 2 at room temperature, and C represents the tensile performance curve of $Ti_2AlNb$-based alloy hollow thin-walled component obtained in Example 4 at room temperature.

Figure 15:
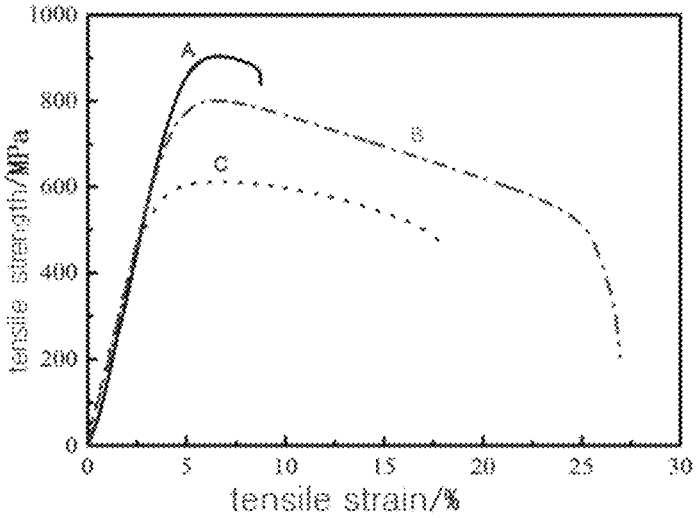

FIG. 15 is tensile performance curves at the temperature of 750° C. In this Figure, A represents the tensile performance curve of the $Ti_2AlNb$-based alloy hollow thin-walled component obtained in Example 3 at the temperature of 750° C., B represents the tensile performance curve of an exemplary $Ti_2AlNb$-based alloy hollow thin-walled component obtained in Example 1 at the temperature of 750° C., C represents the tensile performance curve of the $Ti_2AlNb$-based alloy hollow thin-walled component obtained in Example 4 at the temperature of 750° C.

Figure 16:
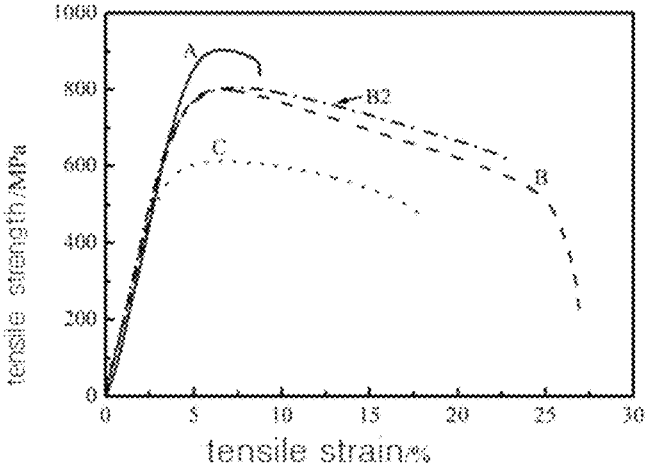

FIG. 16 is tensile performance curves at the temperature of 750° C. In this Figure, A represents the tensile performance curve of the $Ti_2AlNb$-based alloy hollow thin-walled component obtained in Example 3 at the temperature of 750° C., B represents the tensile performance curve of an exemplary $Ti_2AlNb$-based alloy hollow thin-walled component obtained in Example 1, B2 represents the tensile performance curve of an exemplary $Ti_2AlNb$-based alloy hollow thin-walled component obtained in Example 2 at the temperature of 750° C., C represents the tensile performance curve of the $Ti_2AlNb$-based alloy hollow thin-walled component obtained in Example 4 at the temperature of 750° C.

DETAILED DESCRIPTION

Unless otherwise stated, the term "hollow thin-walled component" herein includes "tube" and refers to a hollow component with any shape having a ratio of an outer diameter to a wall thickness being not less than 20.

Unless otherwise stated, the term "hot gas forming" herein can also be called "bulging forming".

In order to more clearly explain the technical solutions pursued in the present invention, exemplary embodiments of this invention are given below. It will be understood by one skilled in this field that the protection scope of the present invention is not limited hereto.

Figure 1:
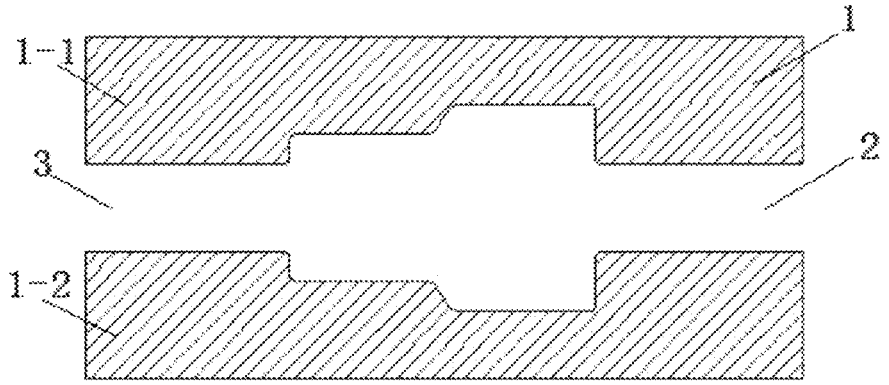
FIG. 1 is a schematic diagram of the structure for the mould in an exemplary specific embodiment. In this Figure, 1 represents the mould, 2 represents the gas inlet, 3 represents the gas outlet, 1-1 represents the upper mould, 1-2 represents the lower mould.
Figure 2:
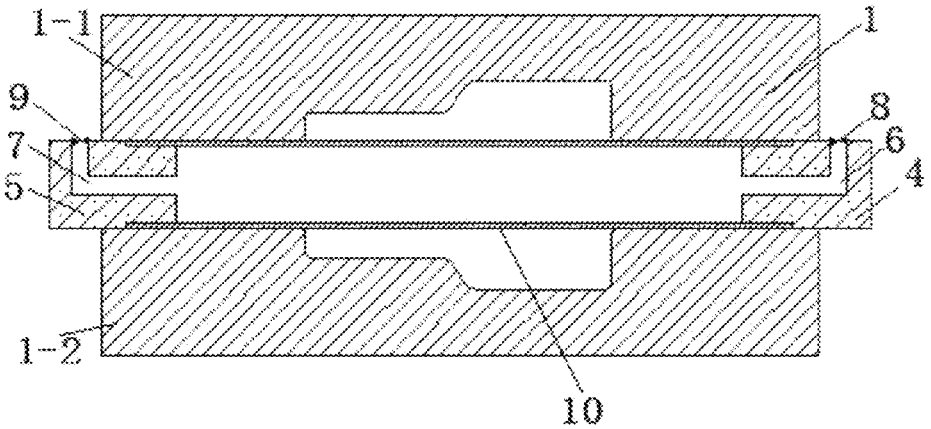
FIG. 2 is a schematic diagram of the structure for the assembled mould in an exemplary specific embodiment. In this Figure, 1 represents the mould, 4 represents the inlet seal plug, 5 represents the outlet seal plug, 6 represents the gas inlet channel, 7 represents the gas outlet channel, 8 represents the inlet switch, 9 represents the outlet switch, 10 represents the tube billet, 1-1 represents the upper mould, 1-2 represents the lower mould.
Figure 3:
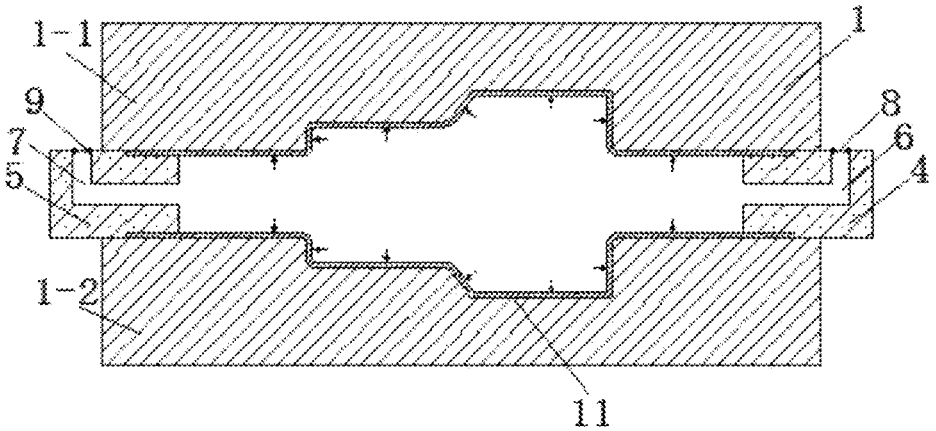
FIG. 3 is a schematic diagram of the structure for the mould after hot gas forming in an exemplary specific embodiment. In this Figure, 1 represents the mould, 4 represents the inlet seal plug, 5 represents the outlet seal plug, 6 represents the gas inlet channel, 7 represents the gas outlet channel, 8 represents the inlet switch, 9 represents the outlet switch, 11 represents the hot gas formed tube component, 1-1 represents the upper mould, 1-2 represents the lower mould.

In one embodiment, based on FIG. 1 to FIG. 3, an exemplary embodiment of the present invention relates to a method of hot gas forming and heat treatment for a $Ti_2AlNb$-based alloy hollow thin-walled component, which comprises the following steps:

(1) hot gas forming: after mould 1 being heated to a forming temperature of 970-990° C., placing tube billet 10 into mould 1, wherein mould 1 is provided with gas inlet 2 and gas outlet 3;

after the mould being assembled, sealing an inlet end and an outlet end of tube billet 10 (one end of tube billet 10 near gas inlet 2 and the other end thereof near gas outlet 3 are defined as the inlet end and the outlet end of tube billet 10, respectively) with inlet seal plug 4 and outlet seal plug 5, respectively, wherein said inlet seal plug 4 is provided with gas inlet channel 6 for supplying gas to a pipeline of tube billet 10 and inlet switch 8 for opening or closing the gas inlet channel, and said outlet seal plug 5 is provided with gas outlet channel 7 for exhausting gas from the pipeline of tube billet 10 and outlet switch 9 for opening or closing the gas outlet channel (namely, inlet seal plug 4 is used to seal the inlet end of tube billet 10, inlet seal plug 4 is provided with gas inlet channel 6 connected with tube billet 10, and inlet switch 8 is set at the external opening of gas inlet channel 6; outlet seal plug 5 is used to seal the outlet end of tube billet 10, outlet seal plug 5 is provided with gas outlet channel 7 connected with tube billet 10, and outlet switch 9 is set at the external opening of gas outlet channel 7);

then, keeping the tube billet at a temperature of 970-990° C. for 5 min-30 min; keeping outlet switch 9 closed and turning on inlet switch 8, allowing compressed gas I to enter the pipeline of tube billet 10 through said gas inlet channel 6; performing the hot gas forming at a temperature of 970-990° C. and an inflation pressure of 5-70 MPa until tube billet 10 is completely formed, thereby obtaining a hot gas formed tube component;

(2) controllable-cooling heat treatment: turning on outlet switch 9, and then introducing compressed gas II from gas inlet channel 6 into a pipeline of the hot gas formed tube component; keeping a gas pressure in the pipeline of the hot gas formed tube component in a range of 1 MPa-20 MPa, and air cooling the hot gas formed tube component at a cooling rate of 0.3-3.5° C./s;

when a temperature of the hot gas formed tube component being reduced to 780-830° C., stopping inletting the gas and keeping it, at a temperature of 780-830° C. for 30-60 min;

then, further introducing said compressed gas II, keeping a gas pressure in the pipeline of the hot gas formed tube component in a range of 1 MPa-20 MPa, and air cooling the hot gas formed tube component at a cooling rate of 0.3-3.5° C./s;

when a temperature of the hot gas formed tube component being reduced to 400-500° C., stopping inletting the gas; opening the mould alter releasing pressure through gas outlet channel 7, and thereby obtaining the $Ti_2AlNb$-based alloy hollow thin-walled component.

Mould 1 described in step (1) of the above exemplary embodiment is consisted of upper mould 1-1 and lower mould 1-2.

FIG. 1 is a schematic diagram of the structure for the mould mentioned in the above exemplary embodiment. In this Figure, 1 represents the mould, 2 represents the gas inlet, 3 represents the gas outlet, 1-1 represents the upper mould, 1-2 represents the lower mould.

FIG. 2 is a schematic diagram of the structure for the assembled mould mentioned in the above exemplary embodiment. In this Figure, 1 represents the mould, 4 represents the inlet seal plug, 5 represents the outlet seal plug, 6 represents the gas inlet channel, 7 represents the gas outlet channel, 8 represents the inlet switch, 9 represents the outlet switch, 10 represents the tube billet, 1-1 represents the upper mould, 1-2 represents the lower mould.

FIG. 3 is a schematic diagram of the structure for the mould after hot gas forming mentioned in the above exemplary embodiment. In this Figure, 1 represents the mould, part 4 represents the inlet seal plug, 5 represents the outlet seal plug, 6 represents the gas inlet channel, 7 represents the gas outlet channel, 8 represents the inlet switch, 9 represents the outlet switch, 11 represents the hot gas formed tube component, 1-1 represents the upper mould, 1-2 represents the lower mould.

In another embodiment, the hot gas forming in the above step (1) may be completed under a vacuum condition.

In another embodiment, the hot gas forming in the above step (1) may also be completed under an inert atmosphere. The inert atmosphere includes, but is not limited to: nitrogen atmosphere, helium atmosphere, neon atmosphere, argon atmosphere, krypton atmosphere, xenon atmosphere and their mixtures, etc.

In another embodiment, in the above step (1), mould 1 may be heated to the forming temperature of 970-990° C. at any heating rate, for example, mould 1 can be heated to the forming temperature of 970-990° C. at a heating rate of 1° C./min to 10° C./min.

In another embodiment, a section of tube billet 10 in the above step (1) may be circular, elliptical or polygonal.

In another embodiment, any tube billet can be used as tube billet 10 in step (1) as long as it meets the requirements that a ratio of outer diameter to wall thickness is not less than 20, while the thickness, outer diameter and length of tube billet 10 are not particularly limited, e.g., in step (1), a thickness of tube billet 10 can be 1 mm-6 mm, an outer diameter of tube billet 10 can be 20 mm-3000 mm, and a length of tube billet 10 can be 100 mm-2000 mm.

In another embodiment, tube billet 10 in step (1) is a $Ti_2AlNb$-based alloy tube billet, and in the $Ti_2AlNb$-based alloy, an atomic percentage of Ti may be 41.5%-58%, an atomic percentage of Al may be 22%-25%, and an atomic percentage of Nb may be 20%-30%.

In another embodiment, the $Ti_2AlNb$-based alloy may also contain Mo, and an atomic percentage of Mo in the $Ti_2AlNb$-based alloy may be 0.01%-1.5%.

In another embodiment, the $Ti_2AlNb$-based alloy may also contain V, and an atomic percentage of V in the $Ti_2AlNb$-based alloy may be 0.01%-2%.

In another embodiment, compressed gas I in step (1) may be a compressed gas of air, a compressed gas of argon, a compressed gas of nitrogen, a compressed gas of helium or a compressed gas of $CO_2$.

In another embodiment, compressed gas II in step (2) may be a compressed gas of air, a compressed gas of argon, a compressed gas of nitrogen, a compressed gas of helium or a compressed gas of $CO_2$.

In another embodiment, a section of the $Ti_2AlNb$-based alloy hollow thin-walled component obtained in step (2) may be circular, elliptical, polygonal or special-shaped.

In another embodiment, an axis shape of the $Ti_2AlNb$-based alloy hollow thin-walled component obtained in step (2) may be a straight line, an In-plane curve or a spatial curve.

The content of this invention is not limited to the contents of the above embodiments, and the combination of one or more of specific embodiments can also achieve the purpose of the invention.

The effectiveness of the present invention is verified by the following experiments, wherein Examples 3 and 4 are comparative Examples.

EXAMPLE 1

The Method of Hot Gas Forming and Heat Treatment for $Ti_2AlNb$-Based Alloy Hollow Thin-Walled Components in this Invention Based on FIG. 1 to FIG. 3, the method of hot gas forming and heat treatment for $Ti_2AlNb$-based alloy hollow thin-walled components described in Example 1 comprises the following steps:

(1) Hot gas forming: after mould 1 was heated to the forming temperature of 970° C. at a heating rate of 8° C./min, tube billet 10 was placed into mould 1, wherein mould 1 was provided with gas inlet 2 and gas outlet 3.

After the mould was assembled, the inlet end and the outlet end of tube billet 10 (one end of tube billet 10 near gas inlet 2 and the other end thereof near gas outlet 3 were defined as the inlet end and the outlet end of tube billet 10, respectively) were sealed with inlet seal plug 4 and outlet outlet seal plug 5, respectively, wherein said inlet seal plug 4 was provided with gas inlet channel 6 for supplying gas to a pipeline of tube billet 10 and inlet switch 8 for opening or closing the gas inlet channel, and said outlet seal plug 5 was provided with gas outlet channel 7 for exhausting gas from the pipeline of tube billet 10 and outlet switch 9 for opening or closing the gas outlet channel.

Then, the tube billet was kept at the temperature of 970° C. for 20 min. Outlet switch 9 was kept closed and inlet switch 8 was turned on; and thus compressed gas I was allowed to enter the pipeline of tube billet 10 through said gas inlet channel 6. The hot gas forming was carried out at the temperature of 970° C. and the inflation pressure of 15 MPa until tube billet 10 was completely formed, and a hot gas formed tube component was thereby obtained.

(2) Controllable-cooling heat treatment: outlet switch 9 was turned on, and then compressed gas II was introduced from gas inlet channel 6 into a pipeline of the hot gas formed tube component. The gas pressure in the pipeline of the hot gas formed tube component was kept at 2 MPa and the hot gas formed tube component was air cooled at a cooling rate of 0.4° C./s.

When the temperature of the hot gas formed tube component was reduced to 800° C., inletting the gas was stopped, and it was kept at the temperature of 800° C. for 30 min.

Then, said compressed gas II was further introduced, the gas pressure in the pipeline of the hot gas formed tube component was kept at 2 MPa, and the hot gas formed tube component was air cooled at a cooling rate of 0.4° C./s.

When the temperature of the formed tube component was reduced to 500° C., inletting the gas was stopped. The mould was opened after releasing pressure through gas outlet channel 7, and the $Ti_2AlNb$-based alloy hollow thin-walled component was thereby obtained.

In Example 1, the hot gas forming in step (1) was completed under a vacuum condition.

In Example 1, the section of the tube biller in step (1) was circular.

In Example 1, the thickness of the tube billet in step (1) was 2 mm, the outer diameter of the tube billet in step (1) was 40 mm, and the length of the tube billet in step (1) was 200 mm.

In Example 1, the tube billet in step (1) was a $Ti_2AlNb$-based alloy tube billet. In the $Ti_2AlNb$-based alloy, the atomic percentage of Ti was 53.5%, the atomic percentage of Al was 22%, and the atomic percentage of Nb was 24%; the $Ti_2AlNb$-based alloy also contained Mo, and the atomic percentage of Mo in the $Ti_2AlNb$-based alloy was 0.5%.

In Example 1, compressed gas I in step (1) was a compressed gas of argon; compressed gas II in step (2) was a compressed gas of argon.

Figure 4:
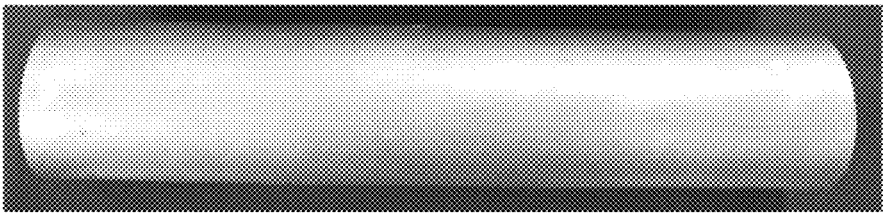
FIG. 4 is an actual photograph of an exemplary tube billet used in step (1) of Example 1.
Figure 5:
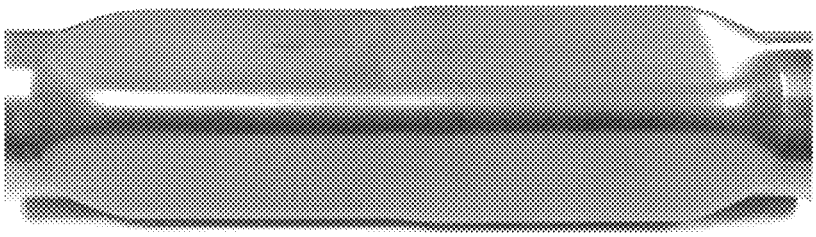
FIG. 5 is an actual photograph of an exemplary $Ti_2AlNb$-based alloy hollow thin-walled component obtained in Example 1.

FIG. 4 is an actual photograph of the tube billet used in step (1) of Example 1. FIG. 5 is an actual photograph of the $Ti_2AlNb$-based alloy hollow thin-walled component obtained in Example 1. By comparing FIG. 5 with FIG. 4, one can see that this Example successfully realized the fabrication of the $Ti_2AlNb$-based alloy hollow thin-walled component from tube billets.

Figure 6:
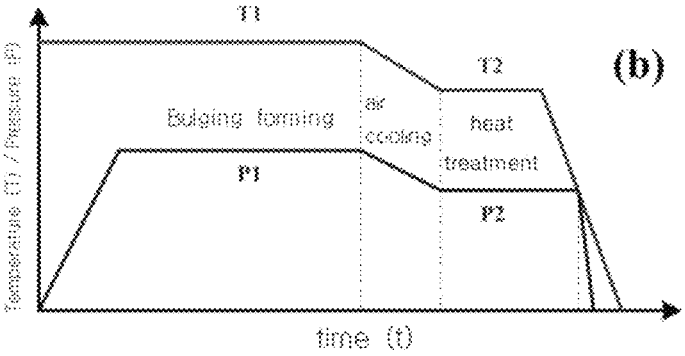
FIG. 6 is a diagram of the hot gas forming and heat treatment process steps for $Ti_2AlNb$-based alloy hollow thin-walled components in Examples 1 and 2. In this Figure, T1 represents the forming temperature, T2 represents the heat treatment temperature, P1 represents the inflation pressure of forming, and P2 represents the gas pressure of heat treatment.

FIG. 6 is a diagram of the hot gas forming and heat treatment process steps for $Ti_2AlNb$-based alloy hollow thin-walled components in Example 1. In this Figure, T1 represents the forming temperature, T2 represents the heat treatment temperature, P1 represents the inflation pressure of forming, and P2 represents the gas pressure of heat treatment. According to FIG. 6, it can be known that this Example uses residual heat to finish the aging heat treatment after forming, which requires no further reheating after cooling and thus reduces the energy consumption.

FIG. 8 is a microstructural image of the $Ti_2AlNb$-based alloy hollow thin-walled component obtained in Example 1. It can be seen from FIG. 8 that, due to the integration technique of performance control as well as hot gas forming and heat treatment forming for the $Ti_2AlNb$-based alloy hollow thin-walled component employed in this Example, the microstructure of the obtained $Ti_2AlNb$-based alloy hollow thin-walled component was optimized, which was exhibited as fine equiaxed $\alpha_2$ phase (dark contrast) and fine lamellar O phase (gray contrast) distributing in $B_2$ phase matrix (brightness contrast), and the thickness of O phase layer being 100-200 nm.

EXAMPLE 2

The Method of Hot Gas Forming and Heat Treatment for $Ti_2AlNb$-Based Alloy Hollow Thin-Walled Components in this Invention Based on FIG. 1 to FIG. 3, the method of hot gas forming and heat treatment for $Ti_2AlNb$-based alloy hollow thin-walled components described in Example 2 comprises the following steps:

(1) Hot gas forming: after mould 1 was heated to the forming temperature of 990° C. at a heating rate of 3° C./min, tube billet 10 was placed into mould 1, wherein mould 1 was provided with gas inlet 2 and gas outlet 3.

After the mould was assembled, the inlet end and the outlet end of tube billet 10 (one end of tube billet 10 near gas inlet 2 and the other end thereof near gas outlet 3 were defined as the inlet end and the outlet end of tube billet 10, respectively) were sealed by plugging gas inlet 2 and gas outlet 3 with inlet seal plug 4 and outlet outlet seal plug 5, respectively, wherein said inlet seal plug 4 was provided with gas inlet channel 6 for supplying gas to a pipeline of tube billet 10 and inlet switch 8 for opening or closing the gas inlet channel, and said outlet seal plug 5 was provided with gas outlet channel 7 for exhausting gas from the pipeline of tube billet 10 and outlet switch 9 for opening or closing the gas outlet channel.

Then, the tube billet was kept at the temperature of 990° C. for 10 min. Outlet switch 9 was kept closed and inlet switch 8 was turned on; and thus compressed gas I was allowed to enter the pipeline of tube billet 10 through said gas inlet channel 6. The hot gas forming was carried out at the temperature of 990° C. and the inflation pressure of 50 MPa until tube billet 10 was completely formed, and a hot gas formed tube component was thereby obtained.

(2) Controllable-cooling heat treatment: outlet switch 9 was turned on, and then compressed gas II was introduced from gas inlet channel 6 into a pipeline of the hot gas formed tube component. The gas pressure in the pipeline of the hot gas formed tube component was kept at 10 MPa and the hot gas formed tube component was air cooled at a cooling rate of 1.5° C./s.

When the temperature of the hot gas formed tube component was reduced to 810° C., inletting the gas was stopped, and it was kept at the temperature of 810° C. for 45 min.

Then, said compressed gas II was further introduced, the gas pressure in the pipeline of the hot gas formed tube component was kept at 10 MPa, and the hot gas formed tube component was air cooled at a cooling rate of 1.5° C./s.

When the temperature of the formed tube component was reduced to 500° C., inletting the gas was stopped. The mould was opened after releasing pressure through gas outlet channel 7, and the $Ti_2AlNb$-based alloy hollow thin-walled component was thereby obtained.

In Example 2, the hot gas forming in step (1) was completed under a vacuum condition.

In Example 2, the section of the tube billet in step (1) was circular.

In Example 2, the thickness of the tube billet in step (1) was 2 mm, the outer diameter of the tube billet in step (1) was 40 mm, and the length of the tube billet in step (1) was 200 mm.

In Example 2, the tube billet in step (1) was a $Ti_2AlNb$-based alloy tube billet. In the $Ti_2AlNb$-based alloy, the atomic percentage of Ti was 53.5%, the atomic percentage of Al was 22%, and the atomic percentage of Nb was 24%; the $Ti_2AlNb$-based alloy also contained Mo, and the atomic percentage of Mo in the $Ti_2AlNb$-based alloy was 0.5%.

In Example 2, compressed gas I in step (1) was a compressed gas of argon; compressed gas II in step (2) was a compressed gas of argon.

FIG. 6 is a diagram of the hot gas forming and heat treatment process steps for $Ti_2AlNb$-based alloy hollow thin-walled components in Example 2. In this Figure, T1 represents the forming temperature, T2 represents the heat treatment temperature, P1 represents the inflation pressure of forming, and P2 represents the gas pressure of heat treatment. According to FIG. 6, it can be known that this Example uses residual heat to finish the aging heat treatment after forming, which requires no further reheating after cooling and thus reduces the energy consumption.

FIG. 9 is a microstructural image of the $Ti_2AlNb$-based alloy hollow thin-walled component obtained in Example 2. It can be seen from FIG. 9 that, due to the integration technique of performance control as well as hot gas forming and heat treatment forming for the $Ti_2AlNb$-based alloy hollow thin-walled component employed in this Example, the microstructure of the obtained $Ti_2AlNb$-based alloy hollow thin-walled component was optimized, which was exhibited as fine equiaxed $\alpha_2$ phase (dark contrast) and fine lamellar O phase (gray contrast) distributing in $B_2$ phase matrix (brightness contrast), and the thickness of O phase layer being 100-200 nm.

EXAMPLE 3

Conventional Method of Hot Gas Forming for $Ti_2AlNb$-Based Alloy Hollow Thin-Walled Components The method includes the following steps:

(1) Hot gas forming: the mould was feared to the forming temperature of 970° C. at a heating rate of 8° C./min, and then the tube billet was placed into the mould. After the mould was assembled, the mould was kept at the temperature of 970° C. for 20 minutes and inflated with a compressed gas. Then the hot gas forming was carried out under the condition of the inflation pressure being 15 MPa and the temperature being 970° C. until the tube billet was completely formed, and a hot gas formed tube component was thereby obtained.

(2) Cooling and heat treatment: the hot gas formed tube component was cooled to room temperature by using rapid cooling via quenching, and then was heated to 800° C., kept at 800° C. for 30 min, followed by rapidly cooling to room temperature via quenching, and the $Ti_2AlNb$-based alloy hollow thin-walled component was thereby obtained.

In Example 3, the hot gas forming in step (1) was completed under a vacuum condition.

In Example 3, the section of the tube billet in step (1) was circular.

In Example 3, the thickness of the tube billet in step (1) was 2 mm, the outer diameter of the tube billet in step (1) was 40 mm, and the length of the tube billet in step (1) was 200 mm.

In Example 3, the tube billet in step (1) was a $Ti_2AlNb$-based alloy tube billet. In the $Ti_2AlNb$-based alloy, the atomic percentage of Ti was 53.5%, the atomic percentage of Al was 22%, and the atomic percentage of Nb was 24%; the $Ti_2AlNb$-based alloy also contained Mo, and the atomic percentage of Mo in the $Ti_2AlNb$-based alloy was 0.5%.

In Example 3, the compressed gas in step (1) was a compressed gas of argon.

EXAMPLE 4

Conventional Method of Hot Gas Forming for $Ti_2AlNb$-Based Alloy Hollow Thin-Walled Components The method includes the following steps:

(1) Hot gas forming: the mould was heated to the forming temperature of 970° C. at a heating rate of 8° C./min, and then the tube billet was placed into the mould. After the mould was assembled, the mould was kept at the temperature of 970° C. for 20 minutes and inflated with a compressed gas. Then the hot gas forming was carried out under the condition of the inflation pressure being 15 MPa and the temperature being 970° C. until the tube billet was completely formed, and a hot gas formed tube component was thereby obtained.

(2) Slow cooling along with the mould (also called "natural cooling") and heat treatment: the hot gas formed tube component was slowly cooled to room temperature along with the mould, and then was heated to 800° C., kept at 800° C. for 30 min, followed by slowly cooling to room temperature along with mould, and the $Ti_2AlNb$-based alloy hollow thin-walled component was thereby obtained.

In Example 4, the hot gas forming in step (1) was completed under a vacuum condition.

In Example 4, the section of the tube billet in step (1) was circular.

In embodiment 4, the thickness of the tube billet in step (1) was 2 mm, the outer diameter of the tube billet in step (1) was 40 mm, and the length of the tube billet in step (1) was 200 mm.

In Example 4, the tube billet in step (1) was a $Ti_2AlNb$-based alloy tube billet. In the $Ti_2AlNb$-based alloy, the atomic percentage of Ti was 53.5%, the atomic percentage of Al was 22%, and the atomic percentage of Nb was 24%; the $Ti_2AlNb$-based alloy also contained Mo, and the atomic percentage of Mo in the $Ti_2AlNb$-based alloy was 0.5%.

In Example 4, the compressed gas in step (1) was a compressed gas of argon.

Figure 7:
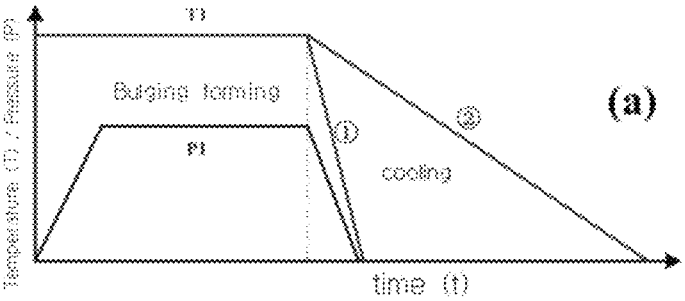
FIG. 7 is a diagram of process steps for forming $Ti_2AlNb$-based alloy hollow thin-walled components in Examples 3 and 4. In this Figure, T1 represents the forming temperature, P1 represents the inflation pressure of forming, ① represents the rapid cooling via quenching, ② represents the slow cooling along with mould.

FIG. 7 is a diagram of process steps for forming $Ti_2AlNb$-based alloy hollow thin-walled components in Examples 3 and 4. In this Figure, T1 represents the forming temperature, P1 represents the inflation pressure of forming, ① represents the rapid cooling via quenching, ② represents the slow cooling along with mould.

FIG. 10 is a microstructural image of a $Ti_2AlNb$-based alloy hollow thin-walled component obtained in Example 3. FIG. 11 is a microstructural image of a $Ti_2AlNb$-based alloy hollow thin-walled component obtained in Example 4. It can be known according to FIG. 10 that, for the $Ti_2AlNb$-based alloy hollow thin-walled component treated by rapid cooling via quenching, there was not enough time for the O phase dissolved in $B_2$ phase matrix to precipitate when bulging at 970° C. because of the high cooling rate, and thus the microstructure thereof was the equiaxed $\alpha_2$ phase distributing in $B_2$ phase matrix without the O phase. It can be known according to FIG. 11 that, the microstructure of $Ti_2AlNb$-based alloy hollow thin-walled component treated by slow cooling along with mould was the equiaxed $\alpha_2$ phase and lamellar O phase distributing in $B_2$ phase matrix. However, the cooling rate was relatively slower in the high-temperature region (970° C. to 850° C.), which resulted in a coarser lamellar O phase with the thickness of 1 μm-2 μm.

FIG. 12 is a diagram of test specimen for tensile performance of $Ti_2AlNb$-based alloy hollow thin-walled component.

FIG. 13 and FIG. 14 are tensile performance curves at room temperature. In these Figures, A represents the tensile performance curve of the $Ti_2AlNb$-based alloy hollow thin-walled component obtained in Example 3 at room Temperature, B represents the tensile performance curve of the $Ti_2AlNb$-based alloy hollow thin-walled component obtained in Example 1 at room temperature, B2 represents the tensile performance curve of the $Ti_2AlNb$-based alloy hollow thin-walled component obtained in Example 2 at room temperature, and C represents the tensile performance curve of $Ti_2AlNb$-based alloy hollow thin-walled component obtained in Example 4 at room temperature.

FIG. 15 and FIG. 16 are tensile performance curves at the temperature of 750° C. In these Figures, A represents the tensile performance curve of the $Ti_2AlNb$-based alloy hollow thin-walled component obtained in Example 3 at the temperature of 750° C., B represents the tensile performance curve of the $Ti_2AlNb$-based alloy hollow thin-walled component obtained in Example 1 at the temperature of 750° C., B2 represents the tensile performance curve of the $Ti_2AlNb$-based alloy hollow thin-walled component obtained in Example 2 at the temperature of 750° C., and C represents the tensile performance curve of the $Ti_2AlNb$-based alloy hollow thin-walled component obtained in Example 4 at the temperature of 750° C.

The tensile tests were carried out for the $Ti_2AlNb$-based alloy hollow thin-walled components obtained in Examples 1 to 4. The tensile tests at room temperature were performed at strain rate of 0.001 $s^{-1}$ by using the tensile specimens shown in FIG. 12. In addition, the tensile specimens shown in FIG. 12 were adopted, and the tensile specimens were put into the furnace when the furnace temperature rose to 750° C., and the temperature was kept for 5 min to make the temperature of the specimen uniform. After that, the tensile tests were carried out at 750° C. with the strain rate of 0.001 $s^{-1}$, and the stress-strain relation was recorded until fracture to obtain the tensile curve, as shown in FIGS. 13 to 16. FIG. 13 and FIG. 14 are tensile performance curves at room temperature. In these Figures, A represents the tensile performance curve of the $Ti_2AlNb$-based alloy hollow thin-walled component obtained in Example 3 at room temperature, B represents the tensile performance curve of the $Ti_2AlNb$ based alloy hollow thin-walled component obtained in Example 1 at room temperature, B2 represents the tensile performance curve of the $Ti_2AlNb$-based alloy hollow thin-walled component obtained in Example 2 at room temperature, and C represents the tensile performance curve of the $Ti_2AlNb$-based alloy hollow thin-walled component obtained in Example 4 at room temperature. FIG. 15 and FIG. 16 are tensile performance curves at the temperature of 750° C. In these Figures, A represents the tensile performance curve of the $Ti_2AlNb$-based alloy hollow thin-walled component obtained in Example 3 at the temperature of 750° C., B represents the tensile performance curve of the $Ti_2AlNb$-based alloy hollow thin-walled component obtained in Example 1 at the temperature of 750° C., B2 represents the tensile performance curve of the $Ti_2AlNb$-based alloy hollow thin-walled component obtained in Example 2 at the temperature of 750° C., and C represents the tensile performance curve of the $Ti_2AlNb$-based alloy hollow thin-walled component obtained in Example 4 at the temperature of 750° C. It can be known according to FIGS. 13 and 14 that, the yield strength, tensile strength and fracture elongation of the $Ti_2AlNb$-based alloy hollow thin-walled component obtained in Example 1 at room temperature were 1214 MPa, 1378 MPa and 14.6%, respectively. The yield strength, tensile strength and fracture elongation of the $Ti_2AlNb$-based alloy hollow thin-walled component obtained in Example 2 at room temperature were 1202 MPa, 1413 MPa and 14.3%, respectively. It can be seen from FIGS. 15 and 16 that, the yield strength, tensile strength and fracture elongation of the $Ti_2AlNb$-based alloy hollow thin-walled component obtained in Example 1 under the high temperature (750° C.) were 688 MPa, 801 MPa and 22.5%, respectively. The yield strength, tensile strength and fracture elongation of the $Ti_2AlNb$-based alloy hollow thin-walled component obtained in Example 2 under the high temperature (750° C.) were 685 MPa, 805 MPa and 19.4%, respectively. It can be seen from FIGS. 13 and 14 that although the fracture elongation of the $Ti_2AlNb$-based alloy hollow thin-walled component obtained in Example 3 at room temperature was 25.5%, its strengths were low, wherein the yield strength was 1110 MPa and the tensile strength was 1112 MPa. Moreover, the yield strength of the $Ti_2AlNb$-based alloy hollow thin-walled component obtained in Example 4 at room temperature was lowest (855 MPa), and its tensile strength was 1124 MPa and its fracture elongation was 14.3%. It can be seen from FIGS. 15 and 16 that the yield strength of the $Ti_2AlNb$-based alloy hollow thin-walled component obtained in Example 3 under the high temperature (750° C.) was 804 MPa, and the tensile strength can reach 906 MPa, but its fracture elongation was lowest (4.3%). Although the fracture elongation of the $Ti_2AlNb$-based alloy hollow thin-walled component obtained in Example 4 at high temperature (750° C.) was 15.1%, its strengths were lowest, wherein the yield strength was 511 MPa and the tensile strength was only 612 MPa. By comparison, the $Ti_2AlNb$-based alloy hollow thin-walled components obtained in Example 1 and Example 2 have the best comprehensive mechanical properties.

For the $Ti_2AlNb$-based alloy hollow thin-walled components obtained in Examples 1 to 4, the shape and dimension accuracies thereof were tested according to the following steps: measuring the cross-section height, width and radius size of rounded corner of the hollow thin-walled components. It can be known according to the test results that, the deviations for the length, width and radius size of rounded corner of the $Ti_2AlNb$-based alloy hollow thin walled components obtained in Example 1 and Example 2 were all less than 0.2 mm, and the deviation of cross-section angle was less than 0.2°, which met the design requirements of this kind of component (the design requirement of size deviation is ≤0.25 mm). However, the maximum deviations for the length, width and cross-section angle of the $Ti_2AlNb$-based alloy hollow thin-walled component obtained in Example 3 were 0.27 mm, 0.25 mm and 0.34°, respectively. Furthermore, the maximum deviations for the length, width and cross-section angle of the $Ti_2AlNb$-based alloy hollow thin-walled component obtained in Example 4 were 0.26 mm, 0.22 mm and 0.26°, respectively. By comparison, the $Ti_2AlNb$-based alloy hollow thin-walled components obtained in Example 1 and Example 2 had the optimized shape and dimension accuracies.

The invention claimed is:

1. A hot gas forming and heat treatment method for a $Ti_2AlNb$-based alloy hollow thin-walled component characterized by comprising the following steps:

(i) hot gas forming: after a mould (1) being heated to a forming temperature of 970-990° C., placing a tube billet (10) into the mould (1), wherein the mould (1) is provided with a gas inlet (2) and a gas outlet (3);

after the mould being assembled, sealing an inlet end and an outlet end of the tube billet (10) with an inlet seal plug (4) and an outlet seal plug (5), respectively, wherein said inlet seal plug (4) is provided with a gas inlet channel (6) for supplying gas to a pipeline of the tube billet (10) and an inlet switch (8) for opening or closing the gas inlet channel, and said outlet seal plug (5) is provided with a gas outlet channel (7) for exhausting gas from the pipeline of the tube billet (10) and an outlet switch (9) for opening or closing the gas outlet channel;

then, keeping the tube billet at a temperature of 970-990° C. for 5 min-30 min, keeping the outlet switch (9) closed and turning on the inlet switch (8), allowing compressed gas (I) to enter the pipeline of the tube billet (10) through said gas inlet channel (6), performing the hot gas forming at a temperature of 970-990° C. and an inflation pressure of 5-70 MPa until the tube billet (10) is completely formed, thereby obtaining a hot gas formed tube component;

(ii) controllable-cooling heat treatment: turning on the outlet switch (9), and then introducing compressed gas (II) from the gas inlet channel (6) into a pipeline of the hot gas formed tube component; keeping a gas pressure in the pipeline of the hot gas formed tube component in a range of 1 MPa-20 MPa, and air cooling the hot gas formed tube component at a cooling rate of 0.3-3.5° C./s;

when a temperature of the hot gas formed tube component is reduced to 780-830° C., the introducing of said compressed gas (II) is stopped, and the hot gas formed tube component is kept at a temperature of 780-830° C. for 30-60 min;

then, further introducing said compressed gas (II), keeping a gas pressure in the pipeline of the hot gas formed tube component in a range of 1 MPa-20 MPa, and air cooling the hot gas formed tube component at a cooling rate of 0.3-3.5° C./s;

when a temperature of the hot gas formed tube component is reduced to 400-500° C., the introducing of said compressed gas (II) is stopped; opening the mould after releasing pressure through the gas outlet channel (7), and thereby obtaining the $Ti_2AlNb$-based alloy hollow thin-walled component.

2. The hot gas forming and heat treatment method for the $Ti_2AlNb$-based alloy hollow thin-walled component according to claim 1, wherein the hot gas forming in step (i) is completed under a vacuum condition.

3. The hot gas forming and heat treatment method for the $Ti_2AlNb$-based alloy hollow thin-walled component according to claim 1, wherein the hot gas forming in step (i) is completed under an inert atmosphere.

4. The hot gas forming and heat treatment method for the $Ti_2AlNb$-based alloy hollow thin-walled component according to claim 3, wherein the inert atmosphere is selected from at least one of nitrogen atmosphere, helium atmosphere, neon atmosphere, argon atmosphere, krypton atmosphere and xenon atmosphere.

5. The hot gas forming and heat treatment method for the $Ti_2AlNb$-based alloy hollow thin-walled component according to claim 1, wherein, in step (i), said mould (1) is heated to the forming temperature of 970-990° C. at a heating rate of 1° C./min to 10° C./min.

6. The hot gas forming and heat treatment method for the $Ti_2AlNb$-based alloy hollow thin-walled component according to claim 1, wherein a section of the tube billet (10) in step (i) is circular, elliptical or polygonal.

7. The hot gas forming and heat treatment method for the $Ti_2AlNb$-based alloy hollow thin-walled component according to claim 1, wherein a ratio of an outer diameter of the tube billet (10) to a wall thickness thereof in step (i) is not less than 20.

8. The hot gas forming and heat treatment method for the $Ti_2AlNb$-based alloy hollow thin-walled component according to claim 7, wherein a thickness of the tube billet (10) is 1 mm-6 mm, an outer diameter of the tube billet is 20 mm-3000 mm, and a length of the tube billet is 100 mm-2000 mm.

9. The hot gas forming and heat treatment method for the $Ti_2AlNb$-based alloy hollow thin-walled component according to claim 1, wherein the tube billet (10) in step (i) is a $Ti_2AlNb$-based alloy tube billet, and in the $Ti_2AlNb$-based alloy, an atomic percentage of Ti is 41.5%-58%, an atomic percentage of Al is 22%-25%, and an atomic percentage of Nb is 20%-30%.

10. The hot gas forming and heat treatment method for the $Ti_2AlNb$-based alloy hollow thin-walled component according to claim 9, wherein the $Ti_2AlNb$-based alloy also contains Mo, and an atomic percentage of Mo in the $Ti_2AlNb$-based alloy is 0.01%-1.5%.

11. The hot gas forming and heat treatment method for the $Ti_2AlNb$-based alloy hollow thin-walled component according to claim 9, wherein the $Ti_2AlNb$-based alloy also contains V, and an atomic percentage of V in the $Ti_2AlNb$-based alloy is 0.01%-2%.

12. The hot gas forming and heat treatment method for the $Ti_2AlNb$-based alloy hollow thin-walled component according to claim 1, wherein compressed gas (I) in step (i) is a compressed gas of air, a compressed gas of argon, a compressed gas of nitrogen, a compressed gas of helium or a compressed gas of $CO_2$.

13. The hot gas forming and heat treatment method for the $Ti_2AlNb$-based alloy hollow thin-walled component according to claim 12, wherein compressed gas (II) in step (ii) is a compressed gas of air, a compressed gas of argon, a compressed gas of nitrogen, a compressed gas of helium or a compressed gas of $CO_2$.

14. The hot gas forming and heat treatment method for the $Ti_2AlNb$-based alloy hollow thin-walled component according to claim 1, wherein a section of the $Ti_2AlNb$-based alloy hollow thin-walled component obtained in step (ii) is circular, elliptical, polygonal or special-shaped.

15. The hot gas forming and heat treatment method for the $Ti_2AlNb$-based alloy hollow thin-walled component according to claim 14, wherein an axis shape of the $Ti_2AlNb$-based alloy hollow thin-walled component obtained in step (ii) is a straight line, an in-plane curve or a space curve.

* * * * *